US010395910B2

(12) United States Patent
Jiang et al.

(10) Patent No.: US 10,395,910 B2
(45) Date of Patent: Aug. 27, 2019

(54) ACCELERATOR MASS SPECTROMETRY DEVICE FOR SIMULTANEOUSLY MEASURING ISOTOPES

(71) Applicant: CHINA INSTITUTE OF ATOMIC ENERGY, Beijing (CN)

(72) Inventors: Shan Jiang, Beijing (CN); Yiwen Bao, Beijing (CN); Ming He, Beijing (CN); Shengyong Su, Beijing (CN); Qubo You, Beijing (CN); Yueming Hu, Beijing (CN); Daqing Cui, Beijing (CN)

(73) Assignee: China Institute of Atomic Energy, Beijing (CN)

( * ) Notice: Subject to any disclaimer, the term of this patent is extended or adjusted under 35 U.S.C. 154(b) by 0 days.

(21) Appl. No.: 15/562,892

(22) PCT Filed: Apr. 1, 2015

(86) PCT No.: PCT/CN2015/075644
§ 371 (c)(1),
(2) Date: Oct. 23, 2017

(87) PCT Pub. No.: WO2016/154958
PCT Pub. Date: Oct. 6, 2016

(65) Prior Publication Data
US 2018/0082828 A1 Mar. 22, 2018

(51) Int. Cl.
*H01J 49/00* (2006.01)
*H01J 49/30* (2006.01)
(Continued)

(52) U.S. Cl.
CPC ..... *H01J 49/0086* (2013.01); *H01J 49/004* (2013.01); *H01J 49/10* (2013.01); *H01J 49/30* (2013.01); *H01J 49/48* (2013.01)

(58) Field of Classification Search
None
See application file for complete search history.

(56) References Cited

U.S. PATENT DOCUMENTS 5,569,915 A 10/1996 Purser et al.
5,644,130 A * 7/1997 Raatz ..... H01J 49/0422 250/288

(Continued)

FOREIGN PATENT DOCUMENTS

CN 1916622 A 2/2007

*Primary Examiner* — James Choi
(74) *Attorney, Agent, or Firm* — Xinsheng Wang; Hon-Man Lee

(57) ABSTRACT

The present invention provides an accelerator mass spectrometry device for simultaneously measuring isotopes. In one embodiment, the device comprises a sputtering negative ion source for generating negative ions; the sputtering negative ion source being connected to an accelerating tube for simultaneously accelerating a plurality of isotopic ions; an output end of the accelerating tube being connected to an isotope mass resolution system; the isotope mass resolution system being connected to a charge conversion analysis and multi-receiving measurement system; the charge conversion analysis and multi-receiving measurement system being connected to an ion detection system. The present invention is capable of accelerating a plurality of isotopic negative ions simultaneously. The accelerated isotopic negative ions are separated. Stable isotopic negative ions are measured by a stable isotope receiver. Unstable isotope negative ions are converted to positive ions and then measured by a detector.

4 Claims, 3 Drawing Sheets

(51) Int. Cl.
*H01J 49/48* (2006.01)
*H01J 49/10* (2006.01)

(56) References Cited

U.S. PATENT DOCUMENTS

| | | | | |
|---|---|---|---|---|
| 2004/0046116 | A1* | 3/2004 | Schroeder | H01J 49/0086 250/281 |
| 2009/0125263 | A1* | 5/2009 | Zurbuchen | G04F 10/00 702/79 |
| 2013/0112869 | A1* | 5/2013 | Synal | H01J 49/005 250/283 |
| 2014/0097338 | A1* | 4/2014 | Eiler | H01J 49/0009 250/282 |
| 2016/0266031 | A1* | 9/2016 | Schlueter | H01J 49/0009 |

* cited by examiner

ACCELERATOR MASS SPECTROMETRY DEVICE FOR SIMULTANEOUSLY MEASURING ISOTOPES

FIELD OF INVENTION

The present invention relates to isotope measurement techniques and, more particularly, to an accelerator mass spectrometry device for simultaneously measuring isotopes.

BACKGROUND OF THE INVENTION

Accelerator Mass Spectrometry (AMS) is a high-energy isotope mass spectrometer based on accelerator technology and ion detector technology and is mainly used for the measurement of isotope abundance ratio. By virtue of an accelerator, the current AMS accelerates and measures isotopes sequentially and alternately thereby analyzing the isotopes. Thanks to the use of an accelerator and a detector, AMS is capable of excluding molecular ion background and isobaric ion background, which has greatly improved the analytical sensitivity and, as a result, the isotope abundance sensitivity can reach up to $1\times10^{-15}$. In contrast, the prior-art mass spectrometer (MS) only has an isotope abundance sensitivity of $1\times10^{-8}$ due to the interference from molecular ion background and isobaric ion background.

Although the AMS is advantageous in that it has a high sensitivity and requires a smaller sample amount, it is more complex in structure than the ordinary MS. Further, as isotopes are injected and measured alternately, the AMS cannot measure the isotopes simultaneously. These have contributed to undesirable measurement accuracy of the AMS, generally around 1%-3%.

The advantages and disadvantages of AMS and MS are shown in the table below:

| | Advantages | Disadvantages |
|---|---|---|
| AMS | The abundance sensitivity is as high as $10^{-15}$; the amount of samples required is less than 0.1 mg. | Isotopes are injected and measured alternately; the accuracy is not high enough, around 1%-3%. |
| MS | More isotopes are received and the accuracy is 0.1%-0.5% higher. | The abundance sensitivity is not high enough ($10^{-8}$). |

The main reason why AMS cannot be used for measuring isotopes simultaneously lies in that, since the application of accelerator from the 1940s, it has been the practice that the accelerator can only accelerate a nuclide ion at a time. The accelerator system consists of an ion injector, an accelerator and a high-energy ion analyzer. One of the main components in the injector is an injection magnet which is intended to select one isotope and injects it into the accelerator for acceleration. To allow more than two isotopes to be measured, the mass parameter of the injector must be alternately changed so as to inject and accelerate the isotopes alternately thereby measuring the isotopes alternately.

Due to alternate measurement of isotopes, two major problems occur with the AMS. First, the measurement accuracy is not high enough, generally about 1%-3%; second, the instrument system of the AMS is more complicated and, as compared with conventional MS, an injection magnet, an alternate injection power supply and a control system in addition to an accelerator are included.

SUMMARY OF THE INVENTION

One embodiment of the present invention provides an accelerator mass spectrometry device for simultaneously measuring isotopes in order to improve the measuring accuracy of mass spectrometry device and simplify its structure, thereby eliminating the drawbacks of the prior art.

To achieve the objective described above, various embodiments of the present invention employ the technical solutions below:

In one embodiment, the present invention provides an accelerator mass spectrometry device for simultaneously measuring isotopes, comprising a sputtering negative ion source for generating negative ions; the sputtering negative ion source being connected to an accelerating tube for simultaneously accelerating a plurality of isotopic negative ions; an output end of the accelerating tube being connected to an isotope mass resolution system; the isotope mass resolution system being connected to a charge conversion analysis and multi-receiving measurement system; the charge conversion analysis and multi-receiving measurement system being connected to an ion detection system.

In one embodiment, the present invention comprises the accelerator mass spectrometry device for simultaneously measuring isotopes as described above, wherein the isotope mass resolution system comprises a first electrostatic analyzer and a magnetic analyzer connected to each other; the first electrostatic analyzer being used for conducting energy analysis of a plurality of isotopic negative ions; the magnetic analyzer being used for separating the plurality of isotopic negative ions.

In one embodiment, the present invention comprises the accelerator mass spectrometry device for simultaneously measuring isotopes as described above, wherein the charge conversion analysis and multi-receiving measurement system comprises an electron stripper, a speed selector, a second electrostatic analyzer and a stable isotope receiver; the stable isotope receiver being used for measuring stable isotopic negative ions; the electron stripper being used for converting unstable isotopic negative ions to positive ions and disintegrating all the molecular ions; the speed selector being used for excluding the disintegrated molecular fragments and scattered ions; the second electrostatic analyzer being used for excluding neutral particles of zero charge state.

In one embodiment, the present invention comprises the accelerator mass spectrometry device for simultaneously measuring isotopes as described above, wherein the stable isotope receiver is a Faraday cup.

In one embodiment, the present invention comprises the accelerator mass spectrometry device for simultaneously measuring isotopes as described above, wherein the ion detection system comprises a detector, a nuclear electronics and data acquisition unit; the detector being used for measuring isotopic positive ions originating from conversion by the electron stripper; the nuclear electronics and data acquisition unit being used for obtaining data from the stable isotope receiver and the detector respectively which, after time matching, offers the contents of a plurality of isotopes measured simultaneously and an abundance ratio thereof.

In one embodiment, the present invention comprises the accelerator mass spectrometry device for simultaneously measuring isotopes as described above, wherein the measurement signal of the stable isotope receiver is delayed by a delay line and then transmitted to the nuclear electronics and data acquisition unit such that it arrives simultaneously with the measurement signal of the detector.

In one embodiment, the present invention comprises any of the accelerator mass spectrometry devices for simultaneously measuring isotopes as described above, further comprising an automatic control system for controlling the operation of each system, isotope measurement, data acquisition and operation, sample replacement as well as vacuum environment.

The advantageous effects of the present invention are as follows:

By virtue of the accelerator mass spectrometry device for simultaneously measuring isotopes according to the present invention, a plurality of isotopic negative ions originating from an ion source are directly admitted into the accelerating tube without passing through the conventional electric and magnetic analyzers so that a plurality of isotopic negative ions is accelerated simultaneously. The plurality of accelerated isotopic negative ions is separated by the isotope mass resolution system. Stable isotopic negative ions are measured by the stable isotope receiver and unstable isotope negative ions are converted to positive ions and then measured by the detector. The isotope signals measured separately are time-matched and then transmitted to the nuclear electronics and data acquisition unit for data operations. The present invention is advantageous in that it is simple in structure and can be convenient to operate and maintain, which make it easy to popularize it in the market and promote its application. Moreover, it is featured with greater measurement accuracy than the conventional AMS, which contributes to more accurate measurement results.

DETAILED DESCRIPTION OF THE INVENTION

Below is a detailed description of the present invention in connection with the accompanying drawings and the preferred embodiments.

Figure 1:
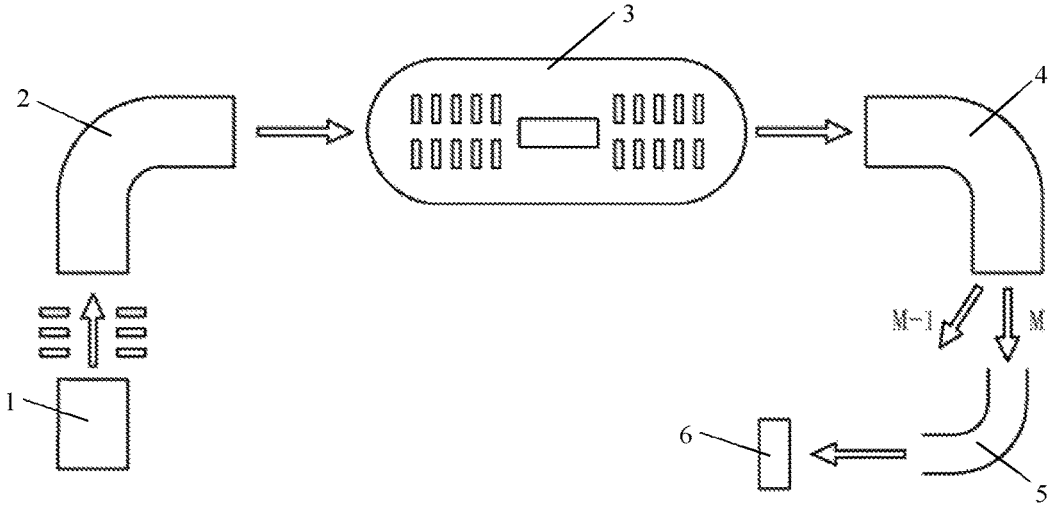
FIG. 1 shows a schematic diagram of a conventional AMS.

FIG. 1 is a schematic diagram of a conventional AMS. As shown in FIG. 1, two isotopes respectively having a mass number of M and M−1 are separated from a sputtering negative ion source 1. AMS is unable to measure the two isotopes simultaneously at rear end of a high-energy magnetic analyzer or electrostatic analyzer; instead, an electrostatic and magnetic analyzer 2 can only select one of the isotopes to be accelerated by a tandem accelerator 3. The accelerated isotope passes through a high-energy magnetic analyzer 4 and a high-energy electrostatic analyzer 5 and arrives at a detector 6. By varying the mass parameter of the injector alternately so as to inject and accelerate the isotopes alternately, the isotopes can be measured alternately.

The accelerator mass spectrometry device of the present invention that has the function of measuring isotopes at the same time is referred to as ST-AMS. ST-AMS mainly serves to solve two technical problems, one of which is accelerating isotopes simultaneously and the other is measuring the isotopes simultaneously.

Figure 2:
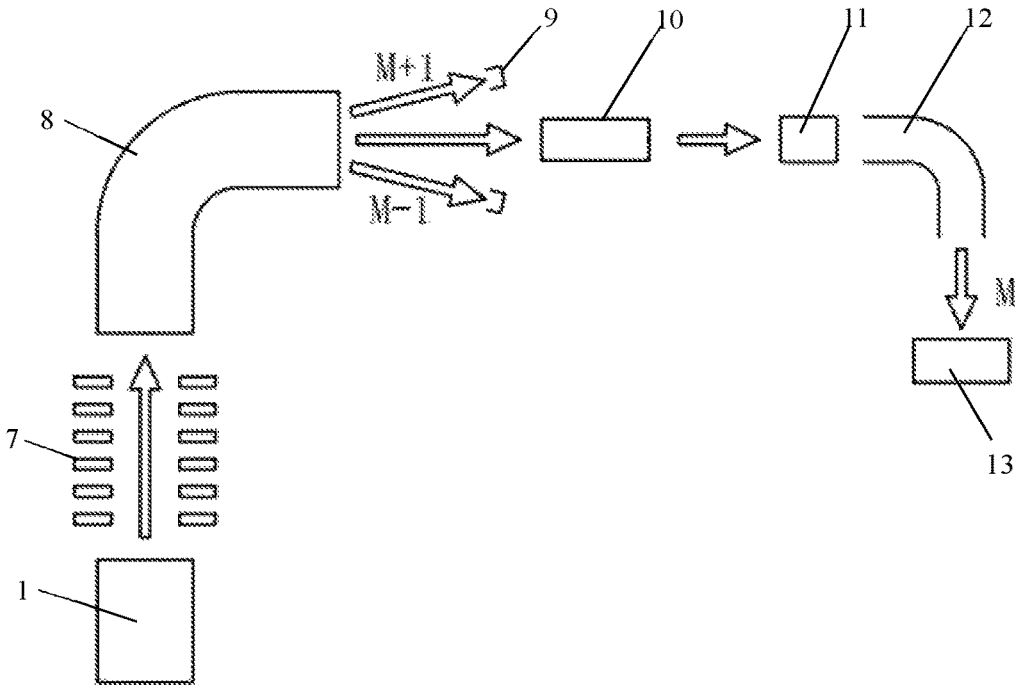
FIG. 2 shows a schematic diagram of a ST-AMS according to the present invention.

FIG. 2 is a schematic diagram of the ST-AMS according to the present invention. As shown in FIG. 2, negative ions originating from the sputtering negative ion source 1 are directly admitted into an accelerating tube 7 (comprising a pre-accelerating tube and a main accelerating tube) and, therefore, the individual isotopic negative ions contained in the negative ions, for example, in the case of carbon isotopes, respectively $^{12}C$, $^{13}C$ and $^{14}C$ negative ions, are all admitted into the accelerator tube to be accelerated. After the negative ions pass through the accelerator, their masses are resolved directly using an electric and magnetic analyzer 8. For example, when carbon isotopes are analyzed using this analyzer, $^{12}C$, $^{13}C$ and $^{14}C$ negative ions among carbon isotopes are separated. $^{12}C$ and $^{13}C$ are stable isotopes and can form negative ion beams capable of being measured directly, $^{12}C$ and $^{13}C$ negative ions are hence capable of being measured simultaneously using a stable isotope receiver 9 (such as a Faraday cup). In contrast, unstable isotopes, for example, $^{14}C$ negative ions, are extremely low in abundance ($^{14}C/^{12}C$ in the range of $10^{-12}$ to $10^{-16}$) so that they cannot form a measurable beam with a maximum of 300 counts per second. Thus, on one hand, a heavy-particle detector is used to record the number of atoms of $^{14}C$ ions and the stable isotope receiver 9 cannot be used. On the other hand, as other isotopic molecular ions, such as $^{13}CH$, $^{12}CH_2$ and $^{7}Li_2$ negative ions, are present in $^{14}C$ negative ions, all the molecular ions are disintegrated through an electron stripper 10 by means of a stripper technique in the AMS analysis method and the disintegrated molecular fragments and scattered ions are excluded through a speed selector 11 and an electrostatic analyzer 12, simply allowing $^{14}C^+$ ions to enter a heavy ion detector 13 and to be recorded. The speed selector 11 is mainly used to exclude the disintegrated molecular fragments and scattered ions and the electrostatic analyzer 12 is mainly used to exclude neutral particles of zero charge state. Since the point of time when $^{14}C^+$ ion arrives at the detector is later than the point of time when $^{12}C$ and $^{13}C$ ion beam streams arrive at the stable isotope receiver 9, the present invention employs a dedicated delay line to delay the signals of the stable isotope receiver such that the signals arrive at the receiver simultaneously with the signals of the detector. In this way, $^{14}C^+$ ions, $^{12}C$ and $^{13}C$ negative ions can be measured simultaneously thereby enabling more isotopes to be received simultaneously.

Below is a description of an embodiment of the present invention with reference to a specific structure of the ST-AMS by taking the analysis on $^{12}C$, $^{13}C$ and $^{14}C$ for example.

Figure 3:
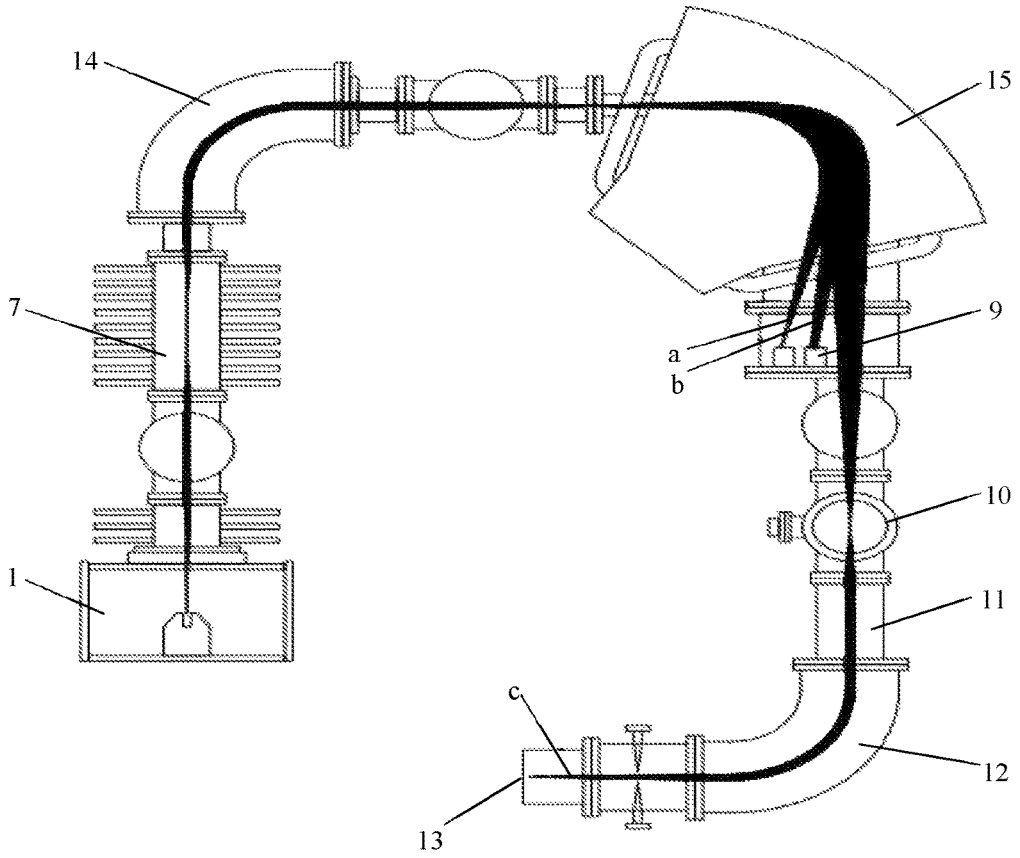
FIG. 3 shows a structural schematic diagram of a ST-AMS in accordance with an embodiment of the present invention that measures carbon isotopes simultaneously.

FIG. 3 is a specific structure of the ST-AMS of the present invention, which comprises five parts, respectively:

Negative ion generation and acceleration system, comprising a sputtering negative ion source 1 and an accelerating tube 7;

Isotope mass resolution system, comprising a first electrostatic analyzer 14 and a magnetic analyzer 15;

Charge conversion analysis and multi-receiving measurement system, comprising an electron stripper 10, a speed selector 11, a second electrostatic analyzer 12 and a stable isotope receiver 9;

Ion detection system, comprising a detector 13 and a nuclear electronics and data acquisition system; and Automatic control system, serving for the control of the above systems, real-time measurement of isotopes, data acquisition and operation, sample replacement as well as automatic control of the vacuum environment.

The sputtering negative ion source 1 is connected to the accelerating tube 7 for simultaneously accelerating a plurality of isotopic ions. The accelerating tube 7 consists of a pre-accelerating section and a main accelerating section and a lens is disposed in the middle thereof, and the output end of the accelerating tube 7 is connected with an isotopic mass resolution system. The first electrostatic analyzer 14 of the isotope mass resolution system conducts energy analysis of a plurality of isotopic ions. The magnetic analyzer 15 separates a plurality of isotopic ions. The stable isotope receiver 9 of the charge conversion analysis and multi-receiving measurement system measures stable isotopic negative ions (such as $^{12}C$ beam stream a, $^{13}C$ beam stream b); the electron stripper 10 converts unstable isotope negative ion (such as $^{14}C$) into a positive ion and disintegrates all molecular ions. The detector 13 of the ion detection system measures isotopic positive ions (such as $^{14}C$ beam stream c) converted by the electron stripper 10. The nuclear electronics and data acquisition unit acquires the data measured by the stable isotope receiver 9 and the detector 13 which, after time matching, offers the contents of multiple isotopes measured simultaneously and abundance ratio thereof. In the present invention, the measurement signals of the stable isotope receiver 9 (a Faraday cup) are delayed by a delay line before transmitted to the nuclear electronics and data acquisition unit such that these signals arrive at the receiver simultaneously with the measurement signals of the detector 13.

Below is a description of the measurement steps of the ST-AMS by taking the measurement of carbon isotopes $^{12}C$, $^{13}C$ and $^{14}C$ contained in atmospheric particulates for example.

Step 1: prepare the sample of atmospheric particulates into graphite;

Step 2: press the prepared graphite sample into a sample target cone which is placed in a Cs ion source;

Step 3: bombard the target material with a Cs ion beam to extract $C^-$ which is then admitted into the pre-accelerating tube and the main accelerating tube to accelerate the ion to the predetermined energy;

Step 4: $C^-$ is then admitted into the first electrostatic analyzer for energy selection, and $^{14}C$, $^{12}C$ and $^{13}C$ are then separated by the magnetic analyzer;

Step 5: $^{12}C$ and $^{13}C$ are measured by the Faraday cup. $^{14}C$ is converted to positive ions through the gas stripper while molecules are disintegrated; the resulting $^{14}C$ is then subject to magnetic field and electric field analysis by a speed selector and a second electrostatic analyzer and the count of $^{14}C$ ions is ultimately obtained by the detector system.

Step 6: after time matching, $^{14}C$, $^{12}C$ and $^{13}C$ as well as the abundance ratio thereof are obtained by the data acquisition system;

Step 7: by comparing the above results with the measurement results obtained from the standard sample, the accurate content of $^{14}C$ can be obtained.

In addition to being useful for the measurement of carbon $^{12}C$, $^{13}C$ and $^{14}C$ isotopes, the present invention is also applicable to simultaneous measurement of nuclides such as $^{3}H$, $^{10}Be$, $^{26}Al$ and their isotopes in a way similar to that described in the above embodiment and those of ordinary skill in the art may tailor the design to the specific situations.

The above disclosure is related to the detailed technical contents and inventive features thereof. A person having ordinary skill in the art may proceed with a variety of modifications and replacements based on the disclosures and suggestions of the invention as described without departing from the idea and scope thereof. Nevertheless, although such modifications and replacements are not fully disclosed in the above descriptions, they have substantially been covered in the following claims as appended.

What is claimed is:

1. An accelerator mass spectrometry device for simultaneously measuring isotopes originated at the same time from a source, comprising a sputtering negative ion source for generating negative ions, said sputtering negative ion source is connected to an accelerating tube which is used for simultaneously accelerating a plurality of isotopic ions, said accelerating tube comprises an output end that is connected to an isotope mass resolution system, said isotope mass resolution system is connected to a charge conversion analysis and multi-receiving measurement system, said charge conversion analysis and multi-receiving measurement system is connected to an ion detection system, wherein there is no other accelerating tube besides said accelerating tube, and all negative ions generated from said negative ion source are simultaneously accelerated in said accelerating tube, wherein the isotope mass resolution system comprises a first electrostatic analyzer connected to a magnetic analyzer, said first electrostatic analyzer conducts energy analysis of a plurality of isotopic ions, and said magnetic analyzer separates the plurality of isotopic ions, wherein the charge conversion analysis and multi-receiving measurement system comprises an electron stripper, a speed selector, a second electrostatic analyzer and a stable isotope receiver, said stable isotope receiver measures stable isotopic negative ions, said electron stripper converts unstable isotopic negative ions to positive ions and disintegrates all molecular ions, said speed selector excludes disintegrated molecular fragments and scattered ions, and said second electrostatic analyzer excludes neutral particles of zero charge, wherein the ion detection system comprises a detector, a nuclear electronics and data acquisition unit, said detector measures isotopic positive ions originating from conversion by said electron stripper, said nuclear electronics and data acquisition unit obtains data from said stable isotope receiver and said detector respectively, and a control system is configured to use time matching to offer measurements of contents of a plurality of isotopes measured simultaneously and an isotope abundance ratio thereof.

2. The device of claim 1, wherein the stable isotope receiver is a Faraday cup.

3. The device of claim 1, wherein signal measured by the stable isotope receiver is delayed by a delay line and then transmitted to the nuclear electronics and data acquisition unit such that it arrives simultaneously with signal measured by the detector.

4. The device of claim 1, further comprising an automatic control system for controlling operation of isotope measurement, data acquisition and operation, sample replacement, vacuum environment and operation of the device.

* * * * *